United States Patent [19]

Montaigne et al.

[11] Patent Number: 4,865,155

[45] Date of Patent: Sep. 12, 1989

[54] HIGH-RISE FIRE FIGHTING AND RESCUE SYSTEM

[75] Inventors: Michael D. Montaigne, Tilton, N.H.; Bernard Lietaer, Georgetown, Cayman Islands

[73] Assignee: Pegasus International, Inc., Cayman Islands

[21] Appl. No.: 222,622

[22] Filed: Jul. 21, 1988

[51] Int. Cl.[4] ..... B66B 9/00

[52] U.S. Cl. ..... 182/14; 182/82; 182/36; 187/6; 187/16; 187/19

[58] Field of Search ..... 187/6-8, 187/2, 12, 16, 19; 182/82, 141, 148, 12-14, 36, 37

[56] References Cited

U.S. PATENT DOCUMENTS

| | | | |
|---|---|---|---|
| 561,223 | 6/1896 | Hamilton | 187/19 |
| 708,838 | 9/1902 | Sferlozza | 187/16 X |
| 930,321 | 8/1909 | Snipes | 187/12 |
| 1,972,258 | 9/1934 | Boyle | 187/16 |
| 2,612,238 | 9/1952 | Angelicola | 187/16 |
| 2,647,675 | 8/1953 | Bernett | 187/6 |
| 3,658,155 | 4/1972 | Salter | 187/19 |
| 3,804,208 | 4/1974 | Iida | 187/19 |
| 3,831,711 | 8/1974 | Smith | 187/6 X |
| 3,866,717 | 2/1975 | Johansson | 187/19 |
| 3,944,021 | 3/1976 | Smith, Jr. et al. | 182/3 |
| 4,018,306 | 4/1977 | Lyons | 187/6 |
| 4,207,965 | 6/1980 | Chiang-Cheng et al. | 182/13 |
| 4,267,900 | 5/1981 | Yin-Lung | 182/13 |
| 4,350,224 | 9/1982 | Jochum et al. | 182/82 |
| 4,355,699 | 10/1982 | Smith, Jr. | 182/12 |
| 4,424,884 | 1/1984 | Smith, Jr. | 182/12 |
| 4,433,752 | 2/1984 | Guenter | 182/82 |
| 4,469,198 | 4/1984 | Crump | 187/08 |
| 4,569,418 | 2/1986 | Novarini | 182/51 |
| 4,664,226 | 5/1987 | Centanne | 182/82 |

FOREIGN PATENT DOCUMENTS

| | | | |
|---|---|---|---|
| 1502163 | 11/1967 | France | 187/12 |

*Primary Examiner*—Joseph J. Rolla
*Assistant Examiner*—Stephen B. Parker
*Attorney, Agent, or Firm*—Kenyon & Kenyon

[57] ABSTRACT

An external elevator system piggy backs a first rail car on a second rail car to permit simple and rapid transfer of the first rail car to an upper setback section of a high-rise building. Each rail car is equipped with pinion drives that engage racks fixed to vertical rails that are attached to the faces of the base section and setback section of the buildings. The cars also have motor driven wheels that allow the car to drive on horizontal surfaces.

11 Claims, 5 Drawing Sheets

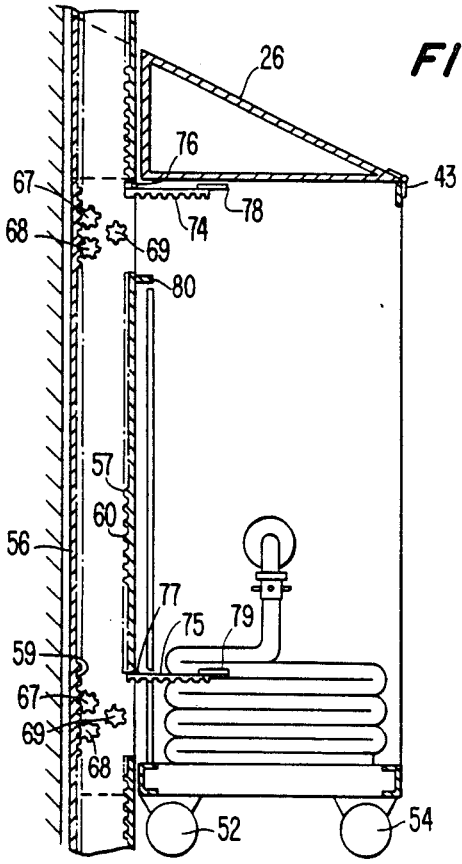
FIG. 6.
FIG. 7.
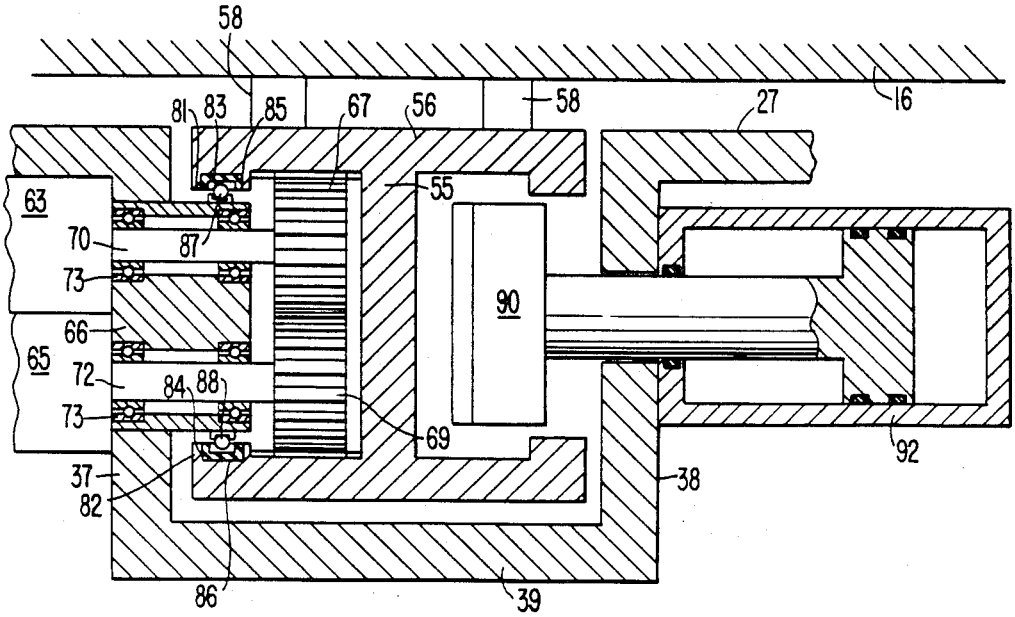

HIGH-RISE FIRE FIGHTING AND RESCUE SYSTEM

BACKGROUND OF THE INVENTION

1. Technical Field

This invention relates to emergency fire fighting and rescue systems for high-rise buildings, and particularly to systems that incorporate an outside elevator using an exterior track on an outside wall of the building.

2. Background Art

Various exterior elevator escape systems for rescuing people from fires or other emergencies in multistory buildings have been proposed for decades. Within the past ten years or so there has been renewed interest in such systems as the result of several major fires in high-rise hotel and office buildings.

The proposed systems are of two principal types, relatively simple evacuation systems, in which individual harnesses or passenger cars are stored at each floor of a building on spurs of a slide track to carry individuals or groups to the ground under the influence of gravity, and more complex true elevator systems, in which cars or gondolas depart from and return to ground.

U.S. Pat. No. 3,944,021 of SMITH, Jr. et al. discloses a gravity escape system that includes a transfer feeder line between two fire escape mechanisms on respective upper and lower building sections that are separated by a setback.

The more sophisticated elevator type of systems use cable hoist or rack and pinion drives for raising and lowering cars. All of the gear drive mechanisms support the car on vertical rails, using guide wheels separate from the drive pinions to support and stabilize the car on the rails.

Power for operating these exterior elevators usually comes from portable generators that are installed in emergency vehicles that may also bring the elevator gondola to the scene from a central station. The electricity from the generator may be delivered to electric drive motors in the rail car either through cables or through bus bars permanently attached to the guide rail on the building. Power may also be available from a supply at the building, or the rail car may have its own engine. Examples of such external elevator systems are disclosed in U.S. Pat. Nos. 4,018,306 of LYONS; 4,469,198 of CRUMP; 4,569,418 of NOVARINI; and 4,664,226 of CENTANNE.

All of the vertical rail external elevator systems of which the applicant is aware are intended to operate a rail car on a single rail or pair of rails extending in a vertical plane to the top of a building. Many highrise buildings, however, are built with one or more setbacks, in accordance with building codes to provide sufficient light and air at ground level. The setbacks on such buildings present a problem for reaching the floors in the upper smaller area sections because the prior art exterior elevator systems provide no way for a rail car to transfer from a first vertical rail or rails, negotiate a lateral setback and then engage with and continue to climb a second vertical rail or rails on the upper section of a building.

SUMMARY OF THE INVENTION

The present invention solves the above problem in a simple and efficient way by providing two rail cars. The first rail car rides "piggy-back" on the second rail car up the first rail until the top of the second car reaches a support structure at the setback level that extends from the first rail to the second rail on the upper section of the building. The first car then drives off the second car onto the support structure and then along the support structure to the side of the upper section for engagement with the second rail.

In particular, the present invention provides an emergency fire fighting and rescue system for a high-rise building having a first multi-story base section with a first vertical side wall and a second multi-story upper section, the upper section having a second vertical side wall that is set back from the first side wall of the base section, the system comprising:

- at least one first vertical rail fixed to the first vertical wall of the base section of the building;
- at least one second vertical rail fixed to the second vertical wall of the upper section of the building;
- a first rail car having means for engaging the at least one second vertical rail for movement longitudinally along said rail;
- a second rail car carrying the first rail car, the second rail car having means for engaging the at least one first vertical rail for movement longitudinally along said rail;
- means for raising and lowering the second rail car along the at least one first rail between ground level and a setback level at the top of the base section of the building;
- means for translating the first rail car from the top of the second rail car, when the second rail car is at the setback level, to engage with the second rail; and
- means for raising and lowering the first rail car along the at least one second rail.

The present invention also provides a method for conducting fire fighting and rescue operations at an upper setback section of a high-rise building, the method comprising:

- engaging a first rail car with at least one first vertical rail fixed to an outer wall of the building below the setback;
- raising the first car on the first rail for a distance approximately equal to the height of the car;
- engaging a second rail car with the at least one first vertical rail below the first car;
- moving one of the first and second rail cars so that the first rail car rests on and is supported by the second rail car;
- raising both rail cars until the top of the second rail car reaches a predetermined level at the setback of the building;
- translating the first rail car across the setback to at least one second vertical rail fixed to an outer wall of the setback section of the building;
- engaging the first rail car with the at least one second vertical rail; and
- raising the first rail car on the second rail to a desired floor level of the upper setback section.

If the building has more than one setback section, a third rail car can be added to raise the second car so that the second car also can traverse the first setback and then raise the first rail car to a position where the first car can translate across a second setback, and so on. The method of the invention thus can be practiced with any number of setbacks, so long as there is available one more rail car than the number of setbacks. For example, four rail cars would be needed to negotiate to the top of a building having three setbacks.

The above and other features of the apparatus and method of the invention will be explained in detail in connection with the attached drawings that illustrate one embodiment of the invention that the applicants currently consider to be the best mode.

BRIEF DESCRIPTION OF THE DRAWINGS

FIG. 6 is a side elevation view of the rail car of FIG. 3 taken the line VI—VI of FIG. 5.

FIG. 7 is an enlarged detail plan view, in cross section, of the rail drive and braking mechanism of the rail car.

DETAILED DESCRIPTION OF THE PREFERRED EMBODIMENTS

Figure 1:
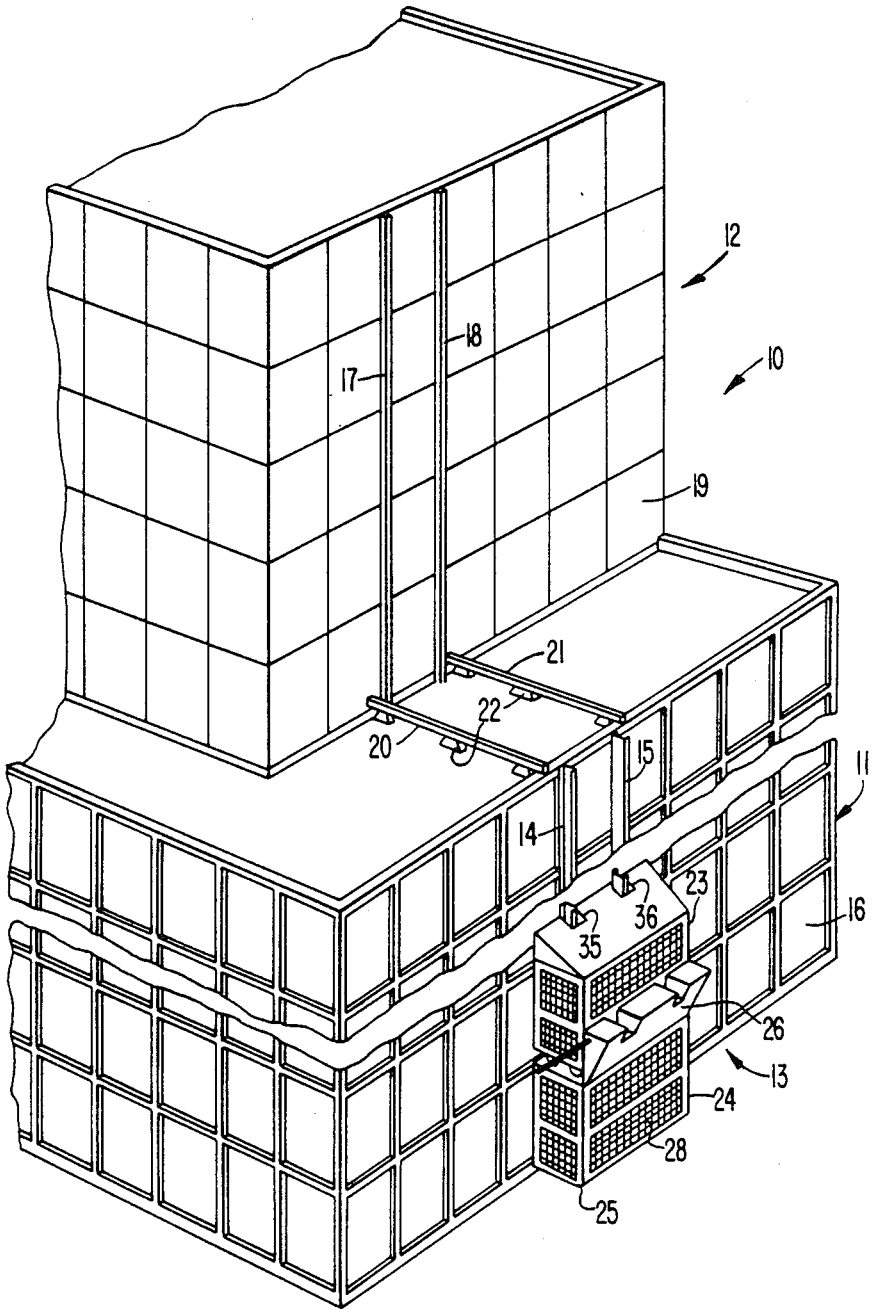
FIG. 1 is a perspective view of an emergency fire fighting and rescue system installed on a high-rise building having a setback.
Figure 2:
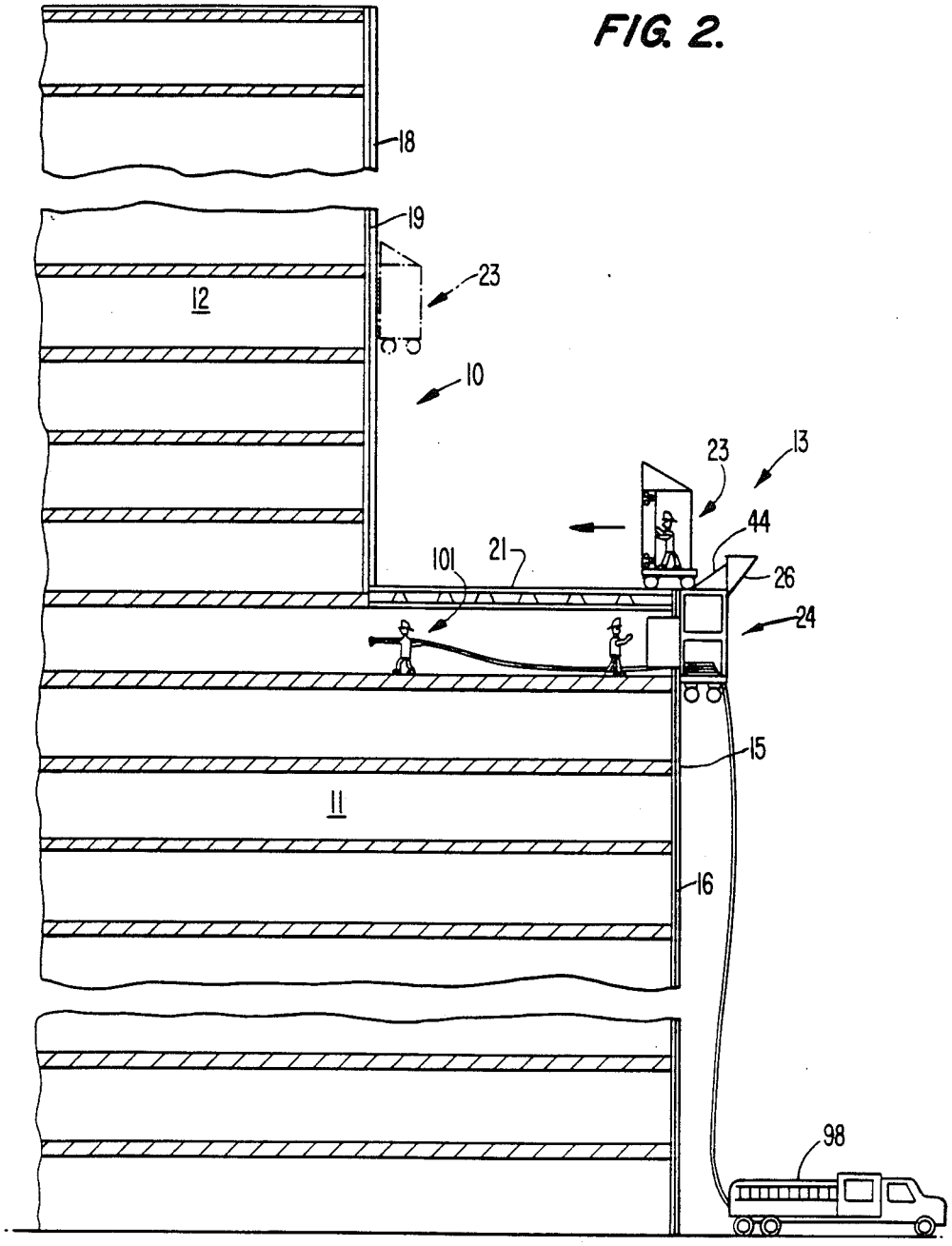
FIG. 2 is a side elevation view, in cross section, of the system shown in FIG. 1.
Figure 3:
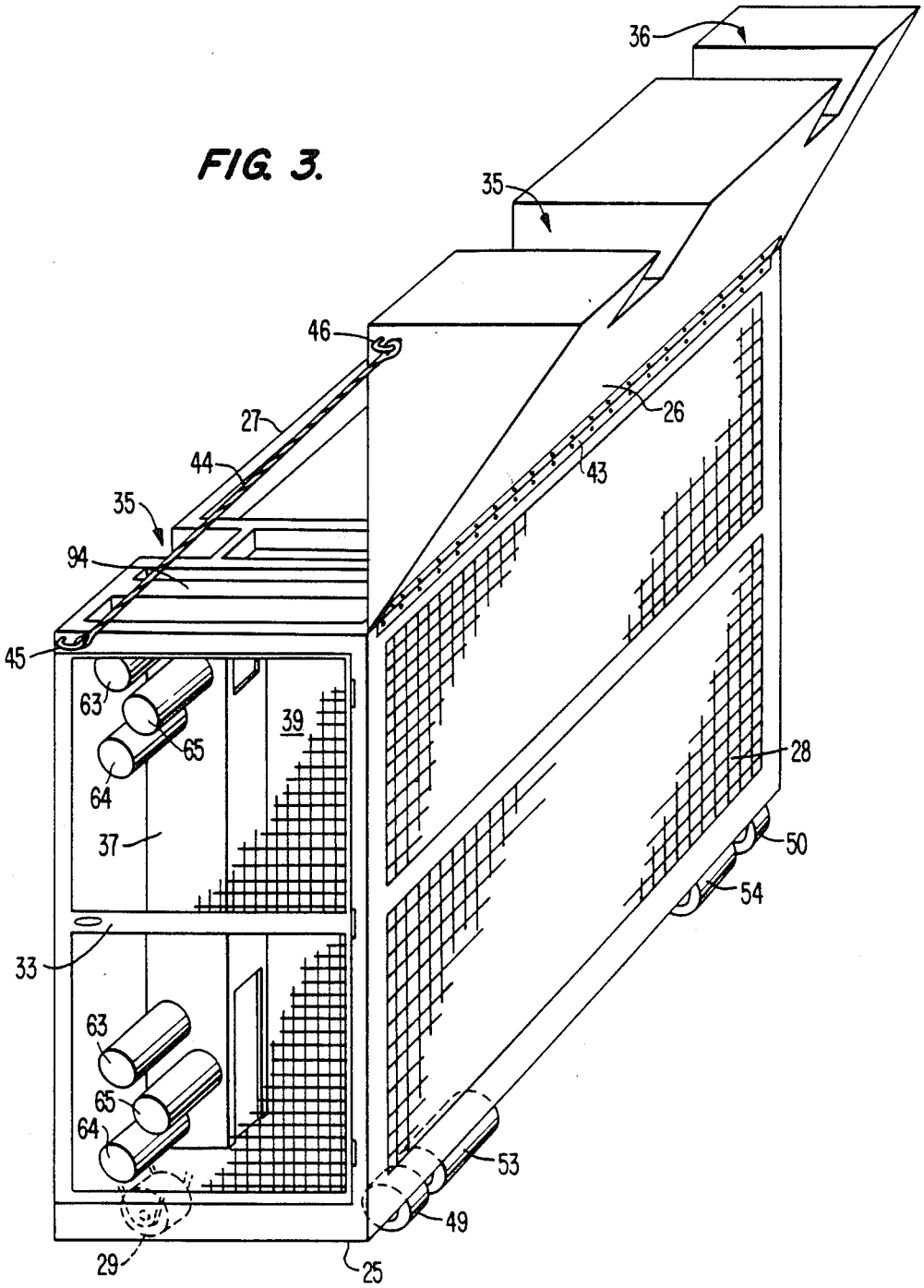
FIG. 3 is a perspective view, partly cut away, of a rail car for use in the fire fighting and rescue system of FIG. 1.
Figure 4:
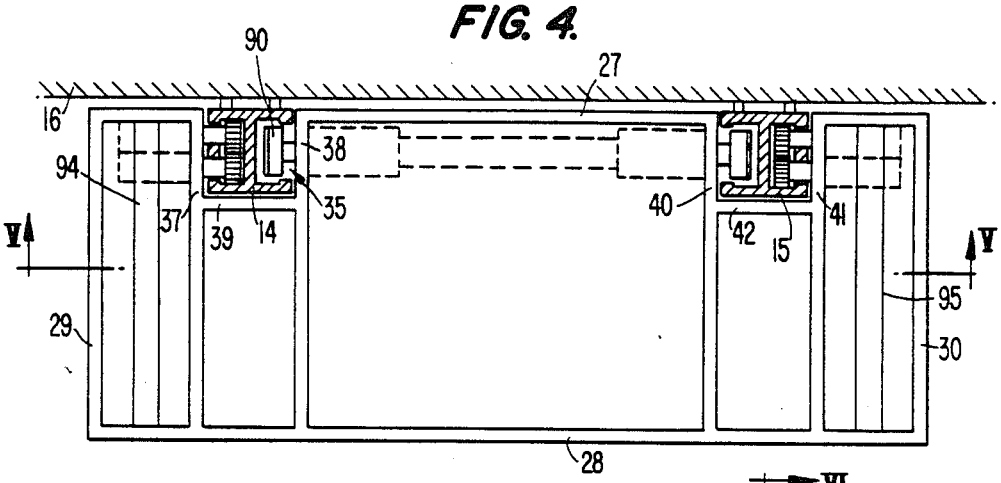
FIG. 4 is a top plan view of the rail car of FIG. 3 taken along the line IV—IV of FIG. 5.
Figure 5:
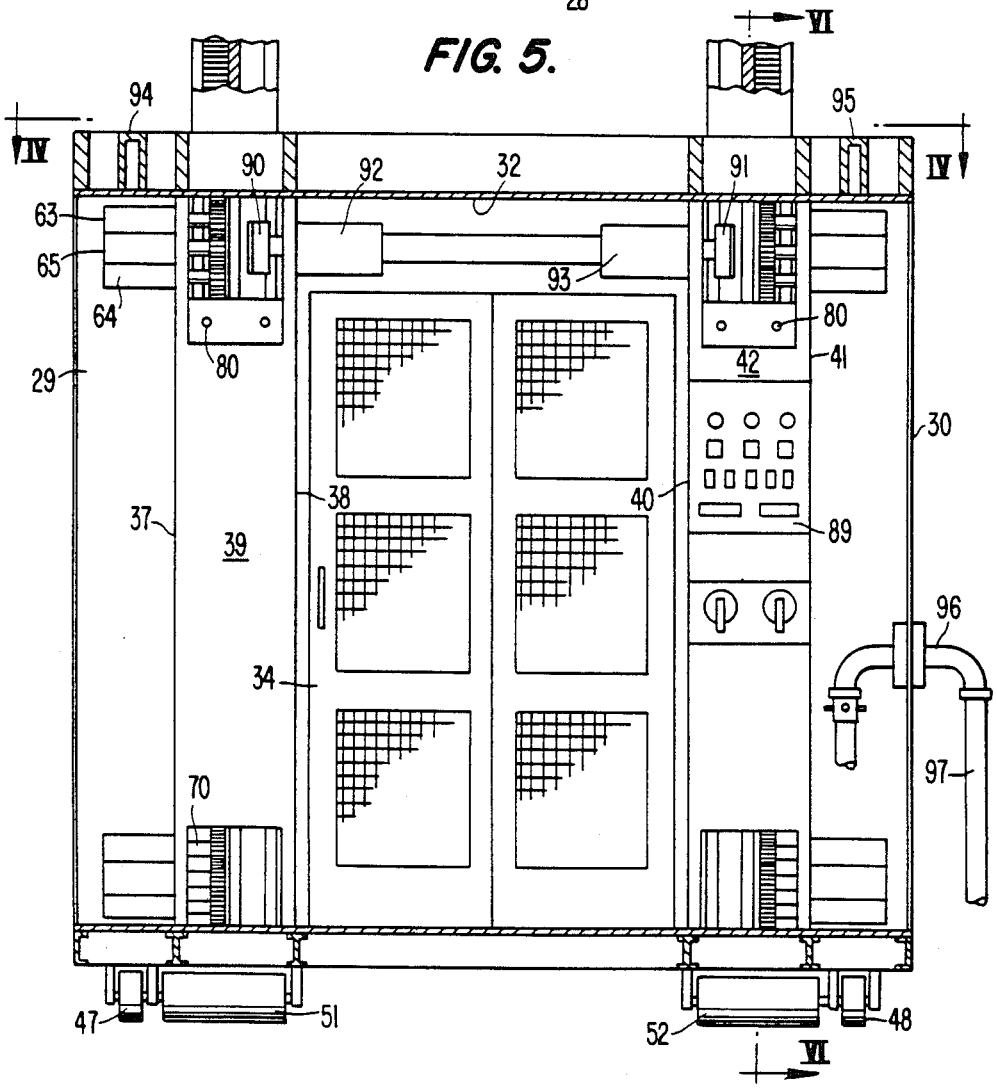
FIG. 5 is a front elevation view in cross section of the rail car of FIG. 3 taken along the line V—V in FIG. 4.

With reference to FIGS. 1 and 2, a multi-story high-rise building 10 having base section 11 and an upper setback section 12 of reduced floor area is equipped with an emergency fire fighting and rescue system designated generally by numeral 13. The system 1 consists of both stationary and movable components. The former include first vertical rails 14,15 fixed to a first vertical wall 16 of the base section 11 and second vertical rails 17,18 fixed to a second vertical wall 19 of the upper section 12. A support structure in the form of tracks 20,21 mounted on piers 22 extends across the space between the first wall 16 of the base section and the second wall 19 of the upper section at the setback level from adjacent the upper ends of first rails 14,15 to adjacent the base of second rails 17,18.

The movable components of the system include a first rail car 23 and a second rail car 24. For economy of construction and maintenance, the first and second rail cars preferably are identical, but this is not necessary. For the purpose of this application, the pertinent features of one rail car will be described in detail, and the other will be considered to be the same.

FIGS. 3 through 6 present various views of a rail car 24. The car has a frame 25 in the form of a rectangular parallelepiped, with a separate sloping roof structure 26 having a right triangular cross section. The frame 25 defines an inner wall 27, an outer wall 28, end walls 29, 30, a floor 31, and a ceiling 32. A hinged door 33 in one end wall and a sliding door 34 in the inner wall 27 provide access to the outside and to the building, respectively.

Two vertical recesses 35,36 formed in inner wall 27 provide space to receive the corresponding vertical rails 14,15. Recess 35 is enclosed by side walls 37,38 and front wall 39, and recess 36 is enclosed by side walls 40,41 and front wall 42 to prevent injury to passengers in the car. Front walls 39 and 42 have access openings to the drive mechanisms that will be described below. Suitable cover plates (not shown) should be provided for these openings except when access is necessary, as during engagement of the car with the rails.

A hinge 43 connects the slanted roof structure 26 to the frame along the top of the outer wall 28 to allow the roof structure to be swung upward and outward to expose the flat top of the frame. Means are provided for limiting the outward swing of the roof, such as a cable 44 attached at its opposite ends to pad eyes 45 and 46 mounted on the frame and the roof structure, respectively, at one end of the car (see FIG. 3). Another cable (not shown) is similarly attached at the other end of the car. In this way, the roof serves as an outer guard to prevent the first rail car from rolling outward from the top of the second rail car.

The rail cars have means for translating the cars horizontally and also means for raising and lowering the cars on the vertical rails. The translating means include a pair of inner or front wheels 47,48 and a pair of outer or rear wheels 49,50. The inner wheels may have individual drive motors 51,52, and the outer wheels may have individual drive motors 53,54. All of the wheels or only one set of wheels, preferably the inner or front wheels, may be pivoted to permit being maneuvered more easily, thus facilitating removal from and return onto a delivery vehicle and also allowing suitable maneuverability between ground level obstacles. In the latter case, the pivoted wheels may not be equipped with drive motors. The individual drive motors for the fixed (non-pivoted) wheels may also be replaced by a single motor driving both wheels through a conventional differential mechanism. Instead of having a pivoted pair of steerable wheels, the rail car could have flanged wheels, and tracks could be provided both at ground level and at the setback level to allow the cars to move toward and away from engagement with the vertical rails without the need to steer the cars.

The means for raising and lowering the cars on the vertical rails includes components fixed to the building as well as components mounted in the rail cars. The fixed components include at least one rack, and in the illustrated embodiment two racks, extending vertically along a surface, or surfaces, of each vertical rail. As shown most clearly in FIG. 7, each rail, such as rail 14 of the illustrated embodiment, is a modified I-beam in cross section. The rail has a central web 55 joining parallel inner and outer flanges 56,57. Suitable fasteners 58 secure the inner flange 56 in spaced relation to the wall 16 of the building. Two racks 59,60 are fixed to, or integrally formed in, facing surfaces 61,62 of respective flanges 56,57 on one side of, web 55.

The components of the raising and lowering means that are mounted on the rail cars constitute, in the illustrated embodiment, four motor drive units. Two motor drive units are mounted at each end of a rail car, and each unit includes three electric motors 63,64, and 65. The three motors of each unit, with integral gear reduction drives, if necessary, are mounted on a srpport plate 66 that is fastened to one of the side walls 37, 41 of vertical recesses 35,36, respectively. One motor drive unit is mounted near the ceiling of the car ar:d one near the floor on each side wall. The three motors 63,64,65 of each unit are provided with pinion gears 67,68,69 mounted on shafts 70,71,72, respectively, each shaft being supported in suitable bearings 73. Motors 63 and 64 of each unit are mounted so that their respective pinions 67,68 mesh with the teeth of rack 59, and the pinion 69 of motor 65 meshes with rack 60.

By providing multiple motor drive units, each containing multiple motors, the illustrated embodiment assures that tooth loading on each pinion is well within design limits. In addition, with the pinions engaging facing racks, the load on individual rack teeth is held to a low level, and in the unlikely event of breakage of a tooth of one rack, the drive system will still be able to raise the car past the level of the broken tooth. Because the racks face each other, the car can be supported solely by the pinions, so that separate rollers or guide shoes are unnecessary.

The means for engaging the rail cars to the rails, as shown in FIG. 6, comprises separable segments 74,75 that span a pair of gaps in the outer flange 57 of each rail. The gaps are sized and spaced to admit simultaneously the pinions of the corresponding motor drive units to the space between the inner and outer flanges of each rail. Hinges 76,77 connect the upper ends of segments 74,75 to the edges of the outer flange 57 at the upper ends of the corresponding gaps to permit the segments to swinq upward so that the drive pinions can enter the gaps as the car moves toward the wall of the building. The previously mentioned access openings in front walls 39 and 42 allow space for the swung-out flange segments to enter the rail car and then to be swung shut by the operator of the car. The lower ends of the segments 74,75 are provided with dogs 78,79 that can be secured by studs 80 on the outer flanges 57 near the lower edges of the gaps to close the gaps when the pinions of each drive unit are within the space between the flanges 56,57.

Although the hinged segments 74,75 represent one way to engage a rail car with a rail, the hinges may be placed on either end of the segments, as convenience dictates, and other suitable latching mechanisms can be used. Alternatively, the gaps can be left open and the drive pinions can be shifted out of the way of the gaps by a jacking or lift mechanism that raises the rail car. Once the upper drive unit pinions are above the upper gap, the car will remain fully engaged with the rail because the cantilevered weight of the car will keep the lower drive unit pinions within the space between the flanges when the lower drive unit ascends past the upper gap. For this reason, the lower segment 75 is unnecessary for securing the rail car and can be eliminated, if desired.

Alternatively, the outer flange 57 of each rail can be left solid, without gaps, and group of vertical drive motors can be mounted on a laterally shiftable support or carriage (not shown) to allow the drive gears to be inserted from the open sides of the rails into engagement with the racks. This arrangement has the additional advantage that the lateral distance between the left and right sets of vertical drive motors can be adjusted to suit the gauge (spacing) between the rails, which may differ on different buildings, or between different sections of the same building.

Power for operating the motors may be delivered by cables to the car, but for greater safety it is preferred to deliver power also through the rails themselves. With reference to FIG. 7, enlarged tips 81,82 of flanges 56,57 are grooved to receive conductors 83,84 carried in insulating channels 85,86. Spring-loaded conductive balls 87,88 mounted on the rail car serve as pick-up brushes to deliver power from the rail through a control panel 89 (FIG. 5) to the drive motors for the raising and lowering units.

If the drive motors are equipped with gear reduction drives of a high enough ratio, these drives will provide an inherent braking effect in the event of power loss. For additional safety, however, the rail cars are equipped with brakes 90,91 actuated by pneumatic or hydraulic cylinders 92,93.

The operation of the fire fighting and rescue system of the invention is as follows. The rail cars may be kept at the site of the building, for example, in an underground shelter and already engaged with the rails of the base section of the building. Alternatively, the rail cars could be kept at a central fire or emezgency station on special purpose vehicles equipped with electric generators for powering the cars.

In the latter case, the vehicles will be dispatched to the scene upon receipt of an alarm. Upon arrival, the cars may be unloaded from the vehicle and driven with the wheel drive motors 51,52, powered through cables (not shown) connected to generators. Control of the motors and steering is accomplished at the control panel 89 inside the car. Alternatively, the cars may be placed on tracks installed at the site to guide each car to the rails at the proper level to permit entry of the upper and lower drive unit pinions into the corresponding gaps in the rails, after the segments, if any are installed, have been swung open or otherwise moved away from the gaps.

Once the first rail car has been engaged with the rails, the raising and lowering drive units are activated from the control panel to move the car an appropriate distance up the rails. The second rail car then drives up and engages with the rails in the same manner as the first. The hinged roof structure of the second car is swung out of the way so that the first car can be lcwered until its wheels rest on ceiling beams 94,95 of the second car. Alternatively, the second car can move up the rails until it contacts the first car. Both cars can then proceed together until they reach the top of the base section of the building.

As the pinions of the drive units of the first car disengage from the racks at the top of the rails the load of both cars will be progressively assumed by the drive units of the second car until the tops of the ceiling beams of the second car are even with the tops of tracks 20,21 at the setback level. The first car at that point will be completely disengaged from the vertical rails 14,15, but the roof structure 26 and restraining cables 44 of the second car will provide an effective safety guard to prevent accidental movement of the first car off the outer edge or ends of the second car.

Although the first car in this position is disengaged from the power source incorporated in the rails, it will continue to receive power through a cable connected to the generator on the ground or to the second car. Consequently, as shown in FIG. 2, the operator of the first car can drive the car off the top of the second car onto the tracks 20,21 to engagement with the rails of the upper section of the building by the same procedure as described above for initial engagement with the lower rails. The first rail car can then proceed up the side of the setback upper section, as illustrated by the phantom car in dashed lines in FIG. 2.

The hinged roof of the rail car also provides the additional advantage that with the roof open, and not occupied by another car, the rail car can easily evacuate people from the roof top of a building without an upper setback and also deliver fire fighters and their equipment as needed.

The primary role for the rail cars is to serve as rescue vehicles for persons trapped on the upper floors of a high-rise building by a fire or other emergency, but they also serve the equally important function of providing access to the building for firemen and equipment. One of the major problems with fires in high-rise buildings has been the inability of firemen to reach the higher floors from the outside of the building and to bring fire hoses to combat the blaze. For example, in a fire on May 5, 1988 in the First Interstate Bank Building in Los Angeles, firemen had to climb fifteen floors with oxygen tanks and then soon ran out of gas in their tanks.

The rail car of the illustrated embodiment includes an external fitting 96 (FIG. 5) for connecting a hose 97 from a pumper truck 98 (FIG. 2), for example. An internal fitting 99 provides connection to a hose 100 carried inside the car. The fittings may incorporate a valve (not shown) to control the flow of water to the hose 100. In this way, a fireman 101 (FIG. 2) can enter the building at any desired floor with sufficient supply of water for at least his own protection. Of course, additional hose fittings can be provided for augumented fire fighting capability. Alternatively, or in addition, fixed fire standpipes can be mounted alongside the rails, with an outlet or outlets at each floor. Also, power lines, compressed air lines, and a communications line can be carried up the building by each car or could be built into the rail itself.

To return the rail cars to ground level with rescued persons or to obtain more firemen or equipment, the above-described operations are followed in reverse. Thus, the present invention provides a simple, rapid, and easily operated arrangement for reaching the upper stories of high-rise buildings having a setback section, for the purposes of fire fighting and emergency evacuation.

Although the embodiment of the invention illustrated in the drawings and described in the specification is a version currently preferred by the applicant, numerous changes could be made in the details of the features and components without departing from the scope of the invention as expressed in the claims. For example, other rail configurations could be used, with different means for engaging the cars with the rails and with raising and lowering devices separate from the devices that support the cars from the rails. Many features of conventional external construction and passenger elevators could be added or substituted for comparable elements of the disclosed embodiment while retaining the advantages of the piggy-back concept, for example.

Nevertheless, the double-rack, multiple pinion drive arrangement described above is considered to be particularly advantageous because of the safety inherent in its redundant design. In this connection, each drive unit need not be limited to three drive motors and pinions, and in the case of three motors, two could be coupled to the outer rack and one to the inner rack, particularly for the upper drive units, where the outer elements carry all of the cantilever moment load directed perpendicularly to the rail flanges a well as their proportionate share of the vertical gravitational load of the cars.

I claim:

1. An emergency fire fighting and rescue system for a high-rise building having a first multi-story base section with a first vertical side wall and a second multi-story upper section, the upper section having a second vertical side wall that is set back from the first side wall of the base section, the system comprising:

at least one first vertical rail fixed to the first vertical wall of the base section of the building;

at least one second vertical rail fixed to the second vertical wall of the upper section of the building;

a first rail car having means for engaging the at least one second vertical rail for movement longitudinally along said rail;

a second rail car, the second rail car having means for engaging the at least one first vertical rail for movement longitudinally along said rail;

means for raising and lowering the first and second rail cars along the at least one first rail between ground level and a setback level at the top of the base section of the building; the second rail car carrying the first rail car above the setback level;

means for translating the first rail car from the top of the second rail car, when the, second rail car is at the setback level, to engage with the second rail; and means for raising and lowering the first rail car along the at least one second rail.

2. A system according to claim 1 wherein the means for translating the first rail car comprises:

wheels mounted on the underside of the first rail car and support structure mounted on the building at the setback level and extending from the top of the second rail car, when the second rail car is at the setback level, to the at least one second vertical rail for supporting the wheels of the first rail car during translation of the first car between the top of the second rail car and the vertical second rail.

3. A system according to claim 2 wherein the support structure comprises a set of parallel rails for guiding the wheels of the first rail car between the top of the second rail car and the at least one second vertical rail.

4. A system according to claim 1 wherein the first rail comprises two parallel spaced apart surfaces facing each other, and the means for raising and lowering the second rail car comprises two racks, each rack extending vertically along a corresponding one of the two facing surfaces of the first rail; at least two pinions mounted on the rail car, one of the pinions meshing with one of the racks and the other pinion meshing with the other rack; and at least two drive motors, each drive motor being coupled to a corresponding one of the pinions.

5. A system according to claim 4 wherein the at least two pinions comprise three pinions, with two of the pinions meshing with one of the racks.

6. A system according to claim 5 wherein the two spaced apart facing surfaces of the first rail are parallel to the first vertical wall of the base section of the building.

7. A system according to claim 4 wherein the two spaced apart facing surfaces of the first rail are parallel to the first vertical wall of the base section of the building.

8. A system according to claim 7 wherein the means for engaging the second rail car with the first rail comprises one of the two parallel spaced apart surfaces being a surface of a first flange and the other of the spaced apart surfaces being a surface of a second flange, the second flange being located further away from the first side wall of the building than the first flange and having a separable segment spanning a gap in the flange large enough to allow introduction of the pinions between the flanges, and means for securing the segment to the first rail.

9. A system according to claim 8 wherein the securing means comprises a hinge attaching one end of the segment to the second flange at one end of the gap in the second flange and means for releasably fastening the other end of the segment to the first rail at the other end of the gap in the second flange.

10. A system according to claim 1 wherein the second rail car comprises a passenger cage having an inner wall adjacent to the first wall of the building, an outer wall spaced from the inner wall, a floor structure joining the inner and outer walls at the bottom of the cage, a ceiling structure joining the inner and outer walls at the top of the cage, the ceiling structure including members for receiving the wheels of the first rail car and for supporting the weight of the first car; a slanted roof for deflecting falling debris, the roof being hingedly attached to the upper edge of the outer wall to allow the roof to be swung outward to expose the members of the ceiling structure; and means for limiting the outward swing of the roof so that the roof serves as an outer guard to prevent the first rail car from rolling outward from the top of the second rail car.

11. A method for conducting fire fighting and rescue operations at an upper setback section of a high-rise building, the method comprising:

engaging a first rail car with at least one first vertical rail fixed to an outer wall of the building below the setback;

raising the first car on the first rail for a distance approximately equal to the height of the car;

engaging a second rail car with the at least one first vertical rail below the first car;

moving one of the first and second rail cars so that the first rail car rests on and is supported by the second rail car;

raising both rail cars along the first rail; the second rail car carrying the first rail car above the setback level until the top of the second rail car reaches a predetermined level at the setback of the building;

translating the first rail car across the setback to at least one second vertical rail fixed to an outer wall of the setback section of the building;

engaging the first rail car with the at least one second vertical rail; and raising the first rail car on the second rail to a desired floor level of the upper setback section.

* * * * *